US005227690A

United States Patent [19]

Van Gennip

[11] Patent Number: 5,227,690

[45] Date of Patent: Jul. 13, 1993

[54] CAPPED ELECTRIC LAMP

[75] Inventor: Nicasius G. T. Van Gennip, Eindhoven, Netherlands

[73] Assignee: U.S. Philips Corporation, New York, N.Y.

[21] Appl. No.: 797,853

[22] Filed: Nov. 26, 1991

[30] Foreign Application Priority Data

Dec. 3, 1990 [NL] Netherlands ..... 9002641

[51] Int. Cl.[5] ..... H01J 5/60

[52] U.S. Cl. ..... 313/318; 313/51; 439/602; 439/605; 439/612; 439/704; 439/232

[58] Field of Search ..... 313/318, 51; 439/602, 439/605, 611, 612, 702, 704, 230

[56] References Cited

U.S. PATENT DOCUMENTS 4,714,858 12/1987 Sanders ..... 439/611 X
4,816,977 3/1989 Sorensen ..... 313/318 X
4,864,184 9/1989 Fleming ..... 439/611 X
5,010,272 4/1991 Eckhardt et al. ..... 313/318

*Primary Examiner*—Donald J. Yusko
*Assistant Examiner*—Ashok Patel
*Attorney, Agent, or Firm*—Robert J. Kraus

[57] ABSTRACT

The lamp has a lamp cap (10) with a metal shell (20), in which an insulator body (30) with a circumferential outer surface (31) between a first and a second end face (32, 33) is locked. Recesses (34) occur at the outer surface (31) at a cross-section (II—II). Between these recesses (34) the outer surface (31) has flattened portions (35), which enable the metal shell (20) to be deformed when the insulator body (30) and the shell (20) are assembled together, and to widen temporarily near the recesses (34). As a result projections (23) in the metal shell (20) can be depressed more deeply than in the case of an outer surface (31) without flattened portions (35). Consequently, the projections (23) press clampingly in the recesses (34) of the outer surface (31), when the metal shell (20) is released, thereby tightly securing the insulator body (30) in the metal shell (20).

14 Claims, 2 Drawing Sheets

CAPPED ELECTRIC LAMP

BACKGROUND OF THE INVENTION

The invention relates to a capped electric lamp comprising:

- a lamp vessel closed in a vacuumtight manner, in which an electric element is positioned;
- a lamp cap connected to the lamp vessel, which lamp cap comprises electric contacts and a metal shell having ends and inwardly directed projections;
- an insulator body having a circumferential outer surface between a first and a second end face, enclosed in the metal shell, in which outer surface recesses are distributed over a cross-section, inwardly directed projections of the metal shell entering the said recesses;
- current supply conductors to the electric element issuing from the lamp vessel to the exterior and connected to electrical contacts of the lamp cap.

Such a capped electric lamp, which may be used as a headlamp in a motor vehicle, is known from DE-GM-8 907 108.5, corresponding to U.S. Pat. No. 5,010,272.

The known lamp has an insulator body with recesses on a cross-section at the second end face, tags being pressed inwards to engage into said recesses, while on a cross-section at a distance therefrom it has a circumferential rim with which other tags cooperate.

A disadvantage of this lamp is that the insulator body is not immovably enclosed in the metal shell. In fact, the tags at the second end face cannot be pressed inwards until after the insulator body has been inserted into the metal shell. These tags can then not be pressed further than up to the point where they touch the insulator body. Since deformations in the metal shell occurring while projections thereof are pressed inwards not only have a plastic but also an elastic component, the inwardly pressed tags will spring back a little. The result of this is that play arises between the insulator body and the shell. This play may have axial, radial and tangential components.

This entails the risk that, owing to vibrations of a vehicle to which the lamp is fastened, or as a result of a manipulation with the lamp, for example, the insertion of the lamp in a lampholder, mechanical forces are exerted on the current supply conductors, so that an electric connection is broken.

SUMMARY OF THE INVENTION

The invention has for its object to provide a capped electric lamp of the kind described in the opening paragraph which, among other characteristics, is of a simple construction and renders possible a rigid fastening of the insulator body in the metal shell. p1 This object is realised in that

- the outer surface of the insulator body has flattened portions between the recesses;
- inwardly directed projections of the metal shell press into the recesses with clamping fit.

It is now possible during the provision of the projections in the presence of the insulator body to press the metal shell against the flattened portions. The metal shell then widens itself opposite the recesses. When the projections which are to press into the recesses are subsequently made, there is much space between the shell and the outer surface in order to form these projections. As a result, they can project farther inward than is the case with an outer surface which is not provided with flattened portions, also after the elastic component of the deformation has been neutralized. The shell may be released after the projections have been provided. The shell then springs back into its original shape, so that the projections will press into the recesses with clamping force as a result of the spring pressure of the shell.

The recesses in the outer surface of the insulator body may lie at a distance from the two end faces. A secure coupling between the metal shell and the insulator body is then achieved already by the projections gripping into these recesses.

It is advantageous, however, if the recesses in the outer surface extend to in the first end face and the shell has at least one inwardly directed projection which presses against the second end face. Such an insulator body can be easily manufactured. A two-part mould can suffice whose parts can be moved along an axis transverse to the end faces of the insulator body to be formed. No core pullers are necessary then for making the recesses. The projection pressing against the second end face may be formed before the insulator body is provided. Taking into account the elastic deformation, this projection may be pressed through a little farther, so that it will occupy the desired position after springing back.

It is favourable if the recesses become wider towards the first end face. This renders a less accurate positioning of the projections possible.

The insulator body is then clamped in by the projections which press into the recesses at the first end face with clamping fit and at least one projection which presses against the second end face.

It is attractive if the recesses become wider and deeper in the direction of the first end face. Such recesses are easy to obtain and also have a positive influence on the operational life of the mould, since the latter is allowed to have fewer sharp edges which are sensitive to wear.

It is favourable if the first end face of the insulator body lies inside the metal shell at a distance from the ends thereof. The metal shell has a greater rigidity between its ends than at its ends.

It is advantageous if the flattened portions of the outer surface become wider towards the first end face. This measure, too, also contributes to a greater durability of the mould. Wear of the mould can be limited in that sharp edges for obtaining the flattened portions can be avoided. In addition, plastic deformation of the metal shell when the metal shell is pressed against the flattened portions of the outer surface is counteracted in that the deformation is evenly distributed in axial direction.

In an attractive embodiment, the inwardly directed projection of the metal shell pressing against the second end face of the insulator body is a circumferential rim. A shell having such a rim is easy to manufacture. The circumferential rim imparts a great rigidity to the shell. The circumferential rim also contributes to an attractive appearance of the lamp.

It is attractive if the projections of the metal shell pressing into the recesses are, substantially hemispherical, elevations. Since the elevations are in contact with the metal shell all round, they have a greater stability than, for example, stamped-out tongues. Hemispherical or tapering elevations easily enter into a stable end position in the recesses.

It is immaterial to the invention whether the insulator body forms part of the lamp cap or whether it is a separate lamp component. The outer surface of the insulator body may be, for example, cylindrical, having, for example, a circular or oval cross-section, but alternatively it may be, for example, a truncated cone.

BRIEF DESCRIPTION OF THE DRAWING

This and other aspects of the capped electric lamp according to the invention will be explained in more detail with reference to the attached drawing figures, in which.

DESCRIPTION OF THE PREFERRED EMBODIMENTS

Figure 1:
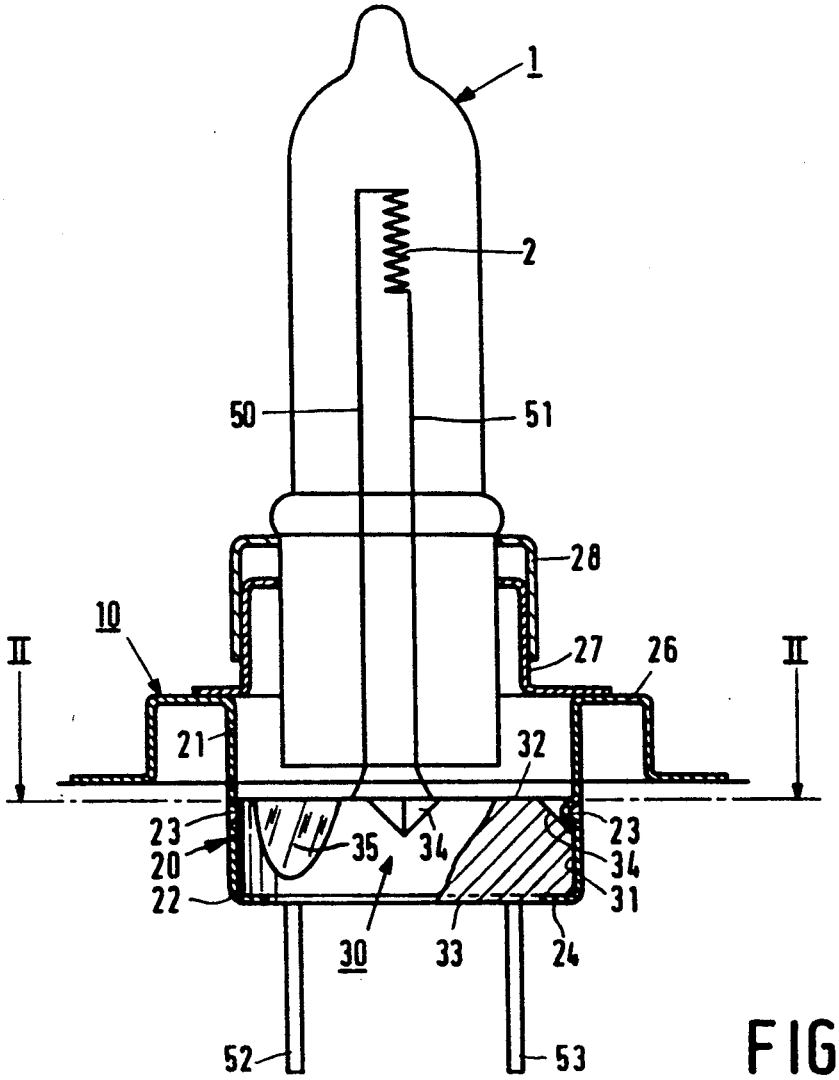
FIG. 1 shows an embodiment in side elevation with the lamp cap partly broken away and partly in cross-section.

In FIG. 1, the capped electric lamp comprises a lamp vessel 1 closed in a vacuumtight manner and made of, for example, quartz glass, in which an electric element 2, in the Figure an incandescent body, is arranged. A lamp cap 10 is connected to the lamp vessel 1. The lamp cap 10 has electric contacts 52, 53 and a metal shell 20 with ends 21, 22 and inwardly directed projections 23. The capped lamp further comprises an insulator body 30 with a circumferential outer surface 31 between a first and a second end face 32 and 33, respectively, which is enclosed in the metal shell 20. Recesses 34 are present in the outer surface 31, distributed over a cross-section II—II, in which recesses inwardly directed projections 23 of the metal shell 20 are present.

The lamp further comprises current supply conductors 50, 51 to the electric element 2 issuing from the lamp vessel 1 to the exterior and connected to electric contacts 52, 53 of the lamp cap 10.

The outer surface 31 of the insulator body 30 has flattened portions 35 between the recesses 34. Inwardly directed projections 23 of the metal shell 20 press with clamping fit into the recesses 34.

In the embodiment shown, the recesses 34 extend to in the first end face 32, and the shell 20 has at least one inwardly directed projection 24 which presses against the second end face 33.

In this embodiment, the recesses 34 become not only wider towards the first end face 32, but become also deeper in that direction.

The first end face 32 lies inside the metal shell 20 at a distance from the ends 21, 22 thereof. The metal shell 20 further has at an end 21 facing the lamp vessel 1, a prefocus ring 26 for accurately positioning the lamp vessel in a reflector. The lamp vessel 1 is connected to this ring 26 via a metal intermediate bush 27 and a clamping bush 28, the incandescent body being aligned relative to the prefocus ring. The incandescent body as a result can be fixed in a predetermined position within a reflector of, for example, a motorcar headlamp.

The flattened portions 35 of the outer surface 31 become wider towards the first end face 32.

The inwardly directed projection 24 of the metal shell 20 pressing against the second end face 33 of the insulator body is a circumferential rim which is obtained by, for example, deep-drawing or rolling.

The projections 23 of the metal shell 20 pressing into the recesses 34 are substantially hemispherical elevations, but they may alternatively be, for example, tapering in shape.

Figure 2:
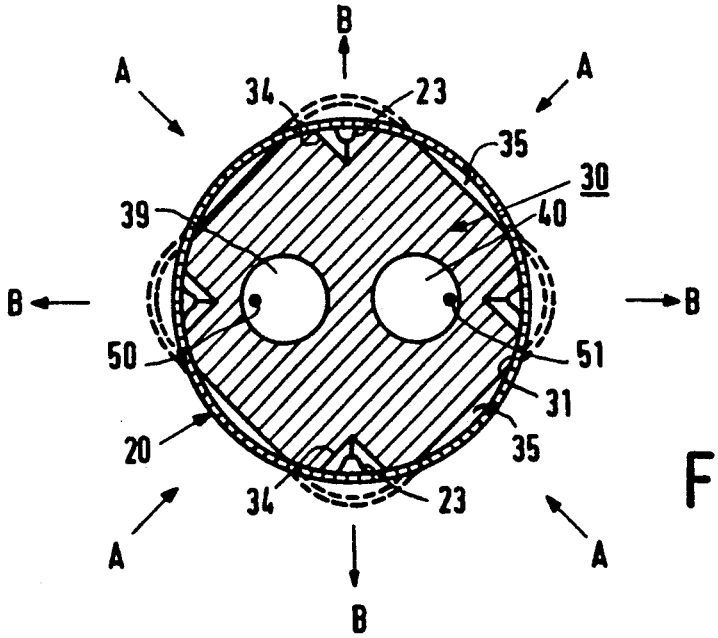
FIG. 2 shows a cross-section taken on the line II—II of the lamp of FIG. 1.

In FIG. 2, the insulator body 30 has four recesses 34 and the shell 20 has the same number of inwardly directed projections 23 which press with champing fit into the recesses.

In other embodiments, however, there may be two or three projections. It depends on the diameter of the shell 20 whether a greater number can be realised. It is possible already with two, three, or four to obtain an excellent rigid coupling. It is also shown in broken lines in this Figure how the shell 20 becomes wider near the first end face 32 of the insulator body 30 in a direction B opposite the recesses 34 when it is pressed against the flattened portions 35 in directions A.

The insulator body 130 has centering holes 39, 40 for guiding respective current supply conductors 50, 51 towards respective contacts 52, 53, see FIG. 1.

Figure 3:
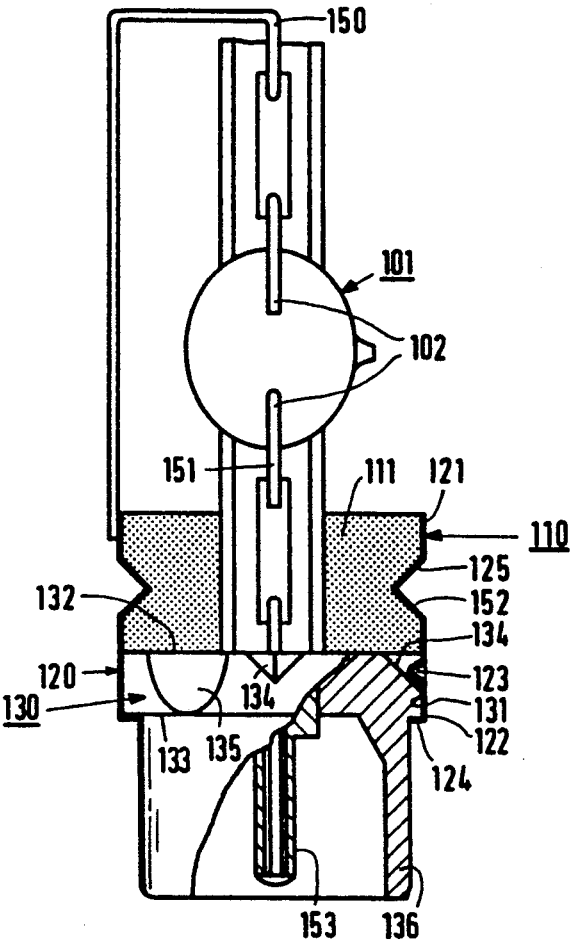
FIG. 3 shows a second embodiment in side elevation with the lamp cap partly broken away and partly in cross-section.

In FIG. 3, parts corresponding to parts of the embodiments shown in FIGS. 1 and 2, have reference numerals which are 100 higher.

In the Figure, the electric element 102 positioned in the lamp vessel 101 is a pair of electrodes. The metal shell 120 has between an end 121 facing the lamp vessel 101 and the first end face 132 of the insulator body 130 a circumferential groove 125 in which retention and contact springs of a lampholder can rest with clamping fit.

The insulator body 130, which in this embodiment forms part of the lamp cap 110, has an extension in the form of a circumferential wall 136 at the second end face 133 and around a first, centrally positioned contact 153 in order to prevent flashover between this contact and the shell 120. The outer surface 131 of the insulator body 130 is substantially cylindrical with a circular cross-section. The lamp vessel 101 is fixed in the metal shell 120 with cement 111 and thus connected to the lamp cap 110. The lamp may be used for making, for example, video shots.

Figure 4:
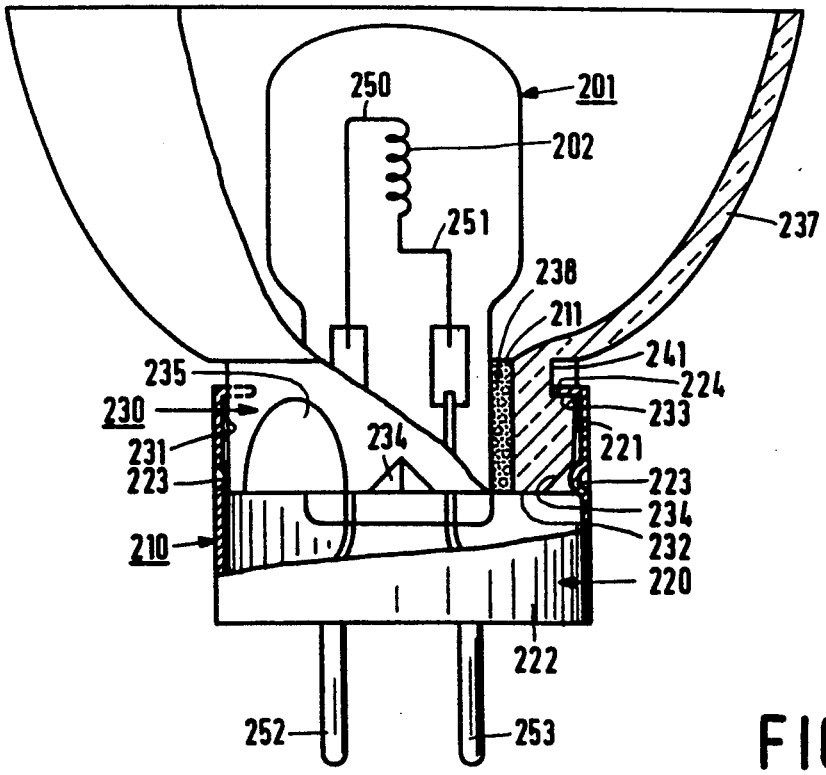
FIG. 4 shows a third embodiment in side elevation, also with the lamp cap partly broken away and partly in cross-section.

In FIG. 4, parts corresponding to parts of the embodiment shown in FIGS. 1 and 2 have reference numerals which are 200 higher. In this embodiment, the insulator body 230 has a central cavity 238 in which the lamp vessel 201 is secured with cement 211. The insulator body 230, which is of a tapering shape in this embodiment, has an extension in the form of a reflecting portion 237 adjacent the second end face 233. Inwardly directed tags 224 press against the second end face 233 of the insulator body 230 in recesses 241.

The lamp/reflector unit shown may be used, for example, for obtaining accent lighting.

I claim:

1. An electric lamp comprising:

a. a lamp vessel containing an electric element;

b. a lamp cap attached to the lamp vessel, said lamp cap comprising a tubular part and having at least one electrical contact electrically connected to the electric element;

c. an insulator body having at least a portion thereof disposed in the tubular part of the lamp cap, said portion including a circumferential outer surface facing an inner surface of said tubular part; and d. means for securing the insulator body to the lamp cap, said means comprising:

(1) a plurality of recesses formed in the outer surface of the insulator body, areas of said outer surface between successive ones of said recesses being indented relative to the inner surface of the tubular part; and (2) a plurality of inwardly directed projections formed in respective first portions of the tubular part said projections being in alignment with respective ones of the recesses and pressing into said recesses against the insulator body, second portions of the tubular part situated between successive ones of said first portions being flexibly depressible toward the indented areas to move said first portions away from the insulator body, thereby enabling said forming of said projections to an increased inward depth.

2. An electric lamp as in claim 1 where said tubular part of the lamp cap is annular and where said surface areas of the insulator body are flat.

3. An electric lamp as in claim 2 where said tubular part of the lamp cap is cylindrical.

4. An electric lamp as in claim 1 where the insulator body is disposed in the tubular part of the lamp cap.

5. An electric lamp as in claim 1 where:

a. the tubular part of the lamp cap has at one end at least one inwardly extending member; and b. the insulator body has at opposite ends thereof respective first and second faces, at least one of the recesses extending into the first end face and the at least one inwardly extending member pressing against the second end face.

6. An electric lamp as in claim 5 where the at least one inwardly extending member comprises a circumferential rim.

7. An electric lamp as in claim 5 where the surface areas of the insulator body widen toward the first end face.

8. An electric lamp as in claim 7 where the at least one inwardly extending member comprises a circumferential rim.

9. An electric lamp as in claim 5 where the recesses widen toward the first end face.

10. An electric lamp as in claim 9 where the recesses deepen toward the first end face.

11. An electric lamp as in claim 5 or 10 where the first end face of the insulator body is disposed in the tubular part of the lamp cap.

12. An electric lamp as in claim 11 where the surface areas of the insulator body widen toward the first end face.

13. An electric lamp as in claim 12 where the at least one inwardly extending member comprises a circumferential rim.

14. An electric lamp as in claim 15, or 10 where the inwardly directed projections have substantially hemispherical shapes.

* * * * *